US005685634A

United States Patent [19]

Mulligan

[11] Patent Number: 5,685,634

[45] Date of Patent: Nov. 11, 1997

[54] LENS ASSEMBLY FOR MATRIX LAMP DISPLAYS

[75] Inventor: Bryan P. Mulligan, Suwanee, Ga.

[73] Assignee: Display Solutions, Inc., Norcross, Ga.

[21] Appl. No.: 701,686

[22] Filed: Aug. 22, 1996

[51] Int. Cl.[6] ..... F21V 1/00

[52] U.S. Cl. ..... 362/237; 362/247; 362/241; 362/294; 362/345

[58] Field of Search ..... 362/237, 238, 362/243, 249, 252, 235, 294, 311, 373, 345, 241, 247

[56] References Cited

U.S. PATENT DOCUMENTS 3,273,140 9/1966 Foster et al. .
3,631,461 12/1971 Powell .
3,750,138 7/1973 Burgan et al. .
4,006,476 2/1977 Romney .
4,683,491 7/1987 Shimada et al. .
4,843,527 6/1989 Britt .
4,940,973 7/1990 Katz .
5,117,343 5/1992 Kerscher et al. .
5,321,417 6/1994 Voelzke et al. .

*Primary Examiner*—Carroll B. Dority
*Attorney, Agent, or Firm*—Cummings & Lockwood

[57] ABSTRACT

A lens assembly is disclosed for a matrix lamp display which includes a reflector portion having a rear wall and plurality of peripheral walls extending forwardly therefrom, and a lens portion having a peripheral frame including structure for engaging the peripheral walls of the reflector portion, an inclined curved lens face extending forwardly from the frame, and a ventilated top wall extending rearwardly from an upper edge of the lens face to the frame.

21 Claims, 4 Drawing Sheets

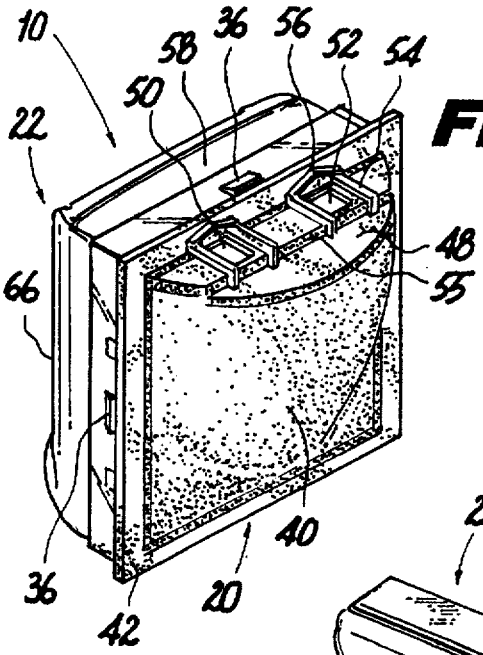
Fig. 8
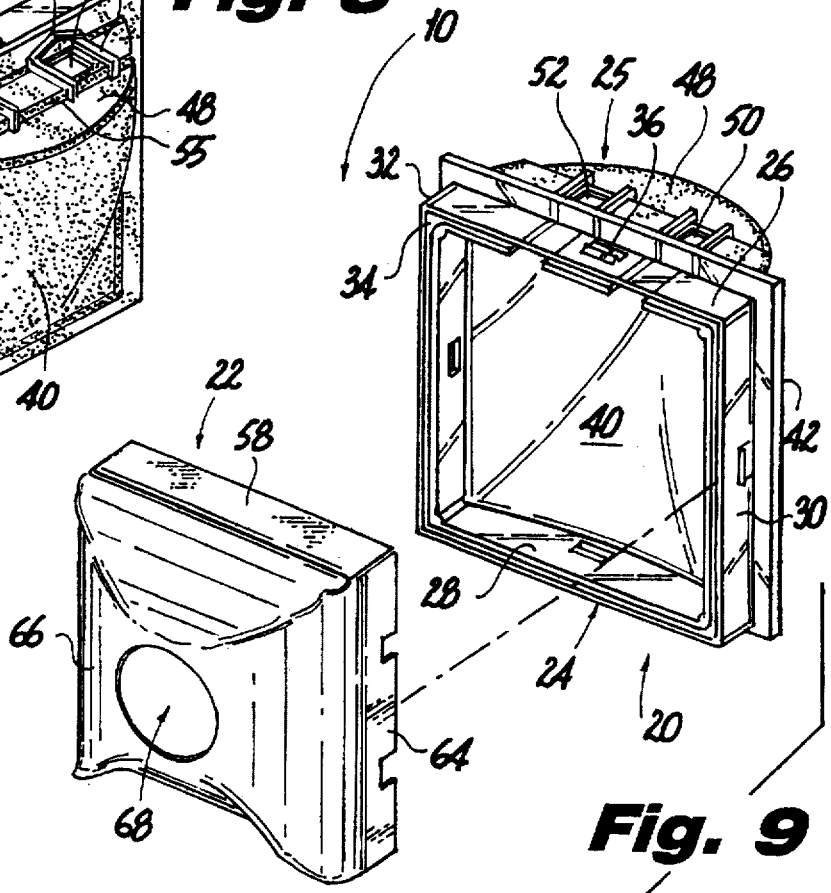
Fig. 9
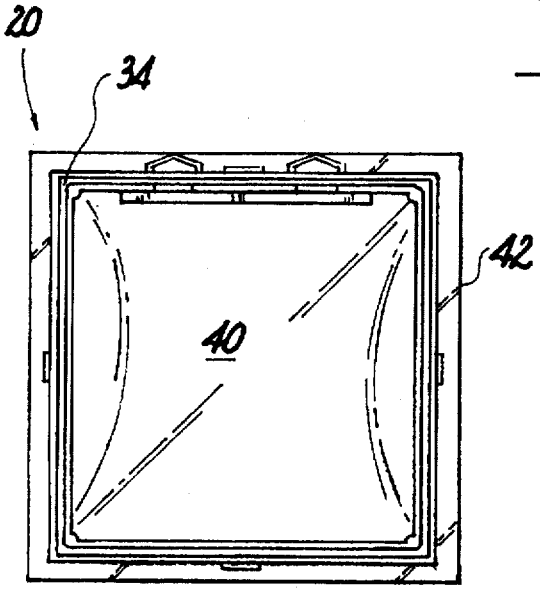
Fig. 10
Fig. 11
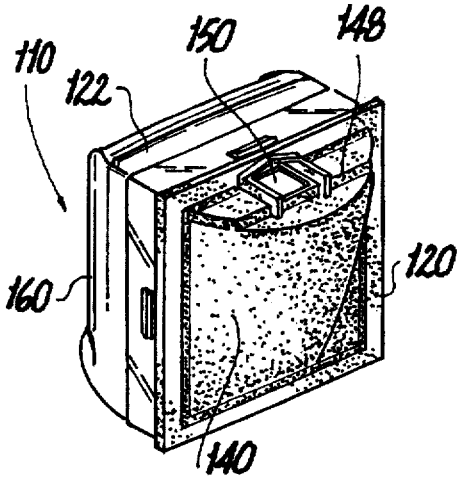

LENS ASSEMBLY FOR MATRIX LAMP DISPLAYS

BACKGROUND OF THE INVENTION

1. Field of the Invention

The subject invention is related to an illuminated display system, and more particularly, to a ventilated lens assembly for a matrix lamp display system which includes an inclined curved lens face configured to provide a wide horizontal viewing angle and reduce glare from sunlight and exterior lighting.

2. Background of the Related Art

Visual display systems comprising a plurality of illuminated display cells arranged in a matrix pattern are well known in the art and have been employed as signs, message boards, and scoreboards for many years. One of the earliest examples of a scoreboard display system of this type is disclosed in U.S. Pat. No. 3,273,140 to Foster et al. This device includes a plurality of lamps mounted on a board in a plurality of vertical columns and horizontal rows. Each lamp is connected to a display switch associated with a control panel which serves to control each lamp individually in response to an operator's typewritten input. Because of the generally planar arrangement of the lamps, this early example of a matrix display system is limited in its ability to project images at a wide viewing angle, such as, for example, within a stadium setting wherein viewers are often seated to the sides of a scoreboard display as well as below the horizontal plane of the display.

A later example of a matrix display apparatus is disclosed in U.S. Pat. No. 4,006,476 to Romney. This apparatus which is comprised of a plurality display modules each containing a multiplicity of display elements arranged within a frame in horizontal rows and vertical columns. Each display element has a hemispherical lens structure associated therewith for projecting an image. Those skilled in the art will recognize that this lens configuration is readily susceptible to the glaring effects of the sun as well as exterior lighting, and is thus unsuited for outdoor applications, such as in a stadium or arena.

A more recent visual display system which is well designed for use in a stadium setting is disclosed in U.S. Pat. No. 4,843,527 to Britt, the specification of which is herein incorporated by reference in its entirety. This device utilizes individually mounted light filtering assemblies each disposed adjacent a lamp and each having a lens which is inclined at angle to the horizon so as to effectively direct light downward toward the viewers as well as reduce glare from sunlight and exterior lighting. In addition, each light filtering assembly has a ventilated top wall to facilitate cooling of the lamp associated therewith, and horizontally extending louvers are associated with each row of lamps to further reduce unwanted glare. A similar, yet less effective lens based visual display system is disclosed in U.S. Pat. No. 5,321,417 to Voelske et at. This system employs inclined ventilated lenses designed to distribute light over a horizontal angle of between 60° and 120° degrees.

Although lens based display systems, such as the system disclosed in the Britt '527 patent, are quite effective at projecting a clear image to a significant number of observers or spectators seated within a stadium or arena, there exists a need in the art to provide a lens based system having an increased horizontal viewing angle, so that an even larger number of spectators seated within a stadium could view the display.

SUMMARY OF THE INVENTION

The subject invention is directed to a unique lens assembly for use in conjunction with a matrix lamp display system which is particularly adapted and configured to direct filtered light, in a significantly wide viewing angle, so that observers located to either side of the display, as well as those located below the horizontal plane of the display, have a clear view thereof. The lens assembly of the subject invention basically includes two parts, a reflector portion and a lens portion. The reflector portion has a rear wall and a plurality of peripheral walls extending forwardly therefrom, and the lens portion has a peripheral frame adapted and configured to engage the peripheral walls of the reflector portion. The lens portion further includes an inclined curved lens face which extends forwardly from the peripheral frame, and a top wall which extends rearwardly from an upper edge of the lens face to the frame.

In a preferred embodiment of the subject invention, the lens portion is of monolithic construction and is fabricated from a thermoplastic material, the surface of which preferably has a matte finish to reduce glare from sunlight and exterior lighting. Preferably, the inclined curved lens face has an inclined double convex configuration, which is delineated by at least two curves, each curve being defined by a different mathematical function, so as to approximate, for example, a generally hemi-paraboloidal shaped formation. The resulting lens configuration provides about a 160° degree horizontal viewing angle to observers.

Preferably, the top wall of the lens portion is ventilated and includes at least one air exhaust port for facilitating the egress of pressurized cooling air from the lens assembly. In addition, the frame of the lens portion preferably includes structure in the form of a peripheral channel for receiving and engaging the peripheral walls of the reflector portion to interlock the two portions of the assembly.

The reflector portion is preferably constructed from a light weight metallic material such as aluminum, which acts as a heat sink to dissipate heat from the lamps. The reflector portion has a concave rear wall with compound curves formed therein to further enhance the horizontal viewing angle provided by the lens assembly. In addition, at least one air intake port is defined in at least one of the peripheral walls of the reflector portion to facilitate the ingress of cooling air into the lens assembly which is subsequently exhausted form the exhaust port(s) in the top wall of the lens portion. The rear wall of the reflector portion preferably has a concave reflective surface on an interior area thereof, and a centrally located aperture extends therethrough for receiving an incandescent lamp.

Further features of the lens assembly of the subject invention and the matrix lamp display system as a whole will become more readily apparent to those having ordinary skill in the art from the following detailed description of the invention taken in conjunction with the drawings.

BRIEF DESCRIPTION OF THE DRAWINGS

So that those having ordinary skill in the art to which the subject invention appertains will more readily understand how to construct and use the lens assembly described herein, preferred embodiments thereof will be described in detail hereinbelow with reference to the drawings wherein:

FIG. 8 is a perspective view of the lens assembly of FIG. 4 with the lens and reflector portions separated from one another for ease of illustration;

FIG. 9 is an exploded perspective view of the lens assembly of FIG. 4, illustrating an interior surface of the lens portion thereof;

FIG. 10 is rear elevational view of the lens portion of the lens assembly illustrated in FIG. 9; and FIG. 11 is a perspective view of another lens assembly constructed in accordance with a preferred embodiment of the subject invention which is smaller in size than the lens assembly of FIG. 4, and which has fewer ventilation ports than the lens assembly of FIG. 4.

DETAILED DESCRIPTION OF THE PREFERRED EMBODIMENTS

In the specification which follows, the side of the matrix lamp display system of the subject invention which is facing the viewer will be referred to as "front" or "forward" while the opposed side will be referred to as "rear" or "back". In addition, since the display system is intended to be arranged in an upright configuration, the top, bottom and sides of the elements forming the display will be referred to in their usual structural and operational relationships, as viewed from the front of the display.

Figure 1:
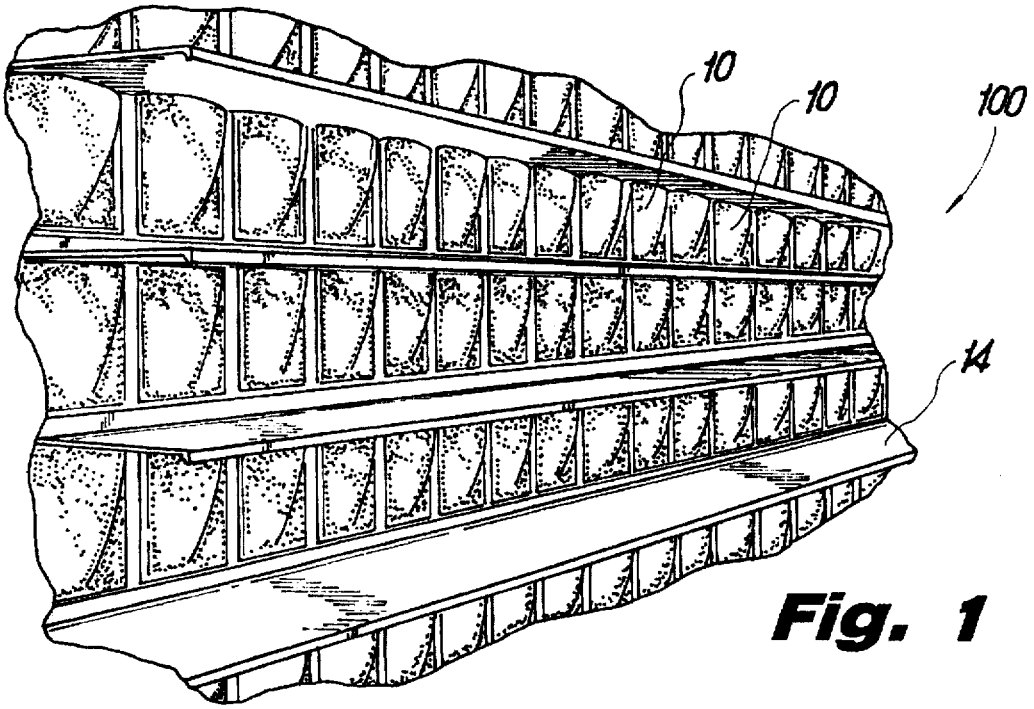
FIG. 1 is a perspective view of a portion of a matrix lamp display system employing a plurality of light faltering lens assemblies constructed in accordance with a preferred embodiment of the subject invention.

Referring now to the drawings wherein like reference numerals identify similar structural elements of the subject invention, there is illustrated in FIG. 1, an improved matrix lamp display system 100 constructed from a plurality of unique lens assemblies, each one constructed in accordance with a preferred embodiment of the subject invention and each one designated generally by reference numeral 10.

Matrix lamp display systems of the type which the subject invention is related are employed in sporting arenas and stadiums to display messages, scores and images to spectators. Within a stadium or arena, these displays are usually located in an elevated position at a location in which a majority of the audience seated either in front of or below the horizontal plane of the display have a clear view thereof. Often however, in many stadiums and arenas, a significant number of seats are located in areas which are on either side of the message board, and thus many spectators will be unable to adequately view the display system. The subject invention overcomes the inadequacies of prior art display systems by constructing a display system 100 with a plurality of lens assemblies 10 configured to provided a significantly wide horizontal viewing angle.

Figure 2:
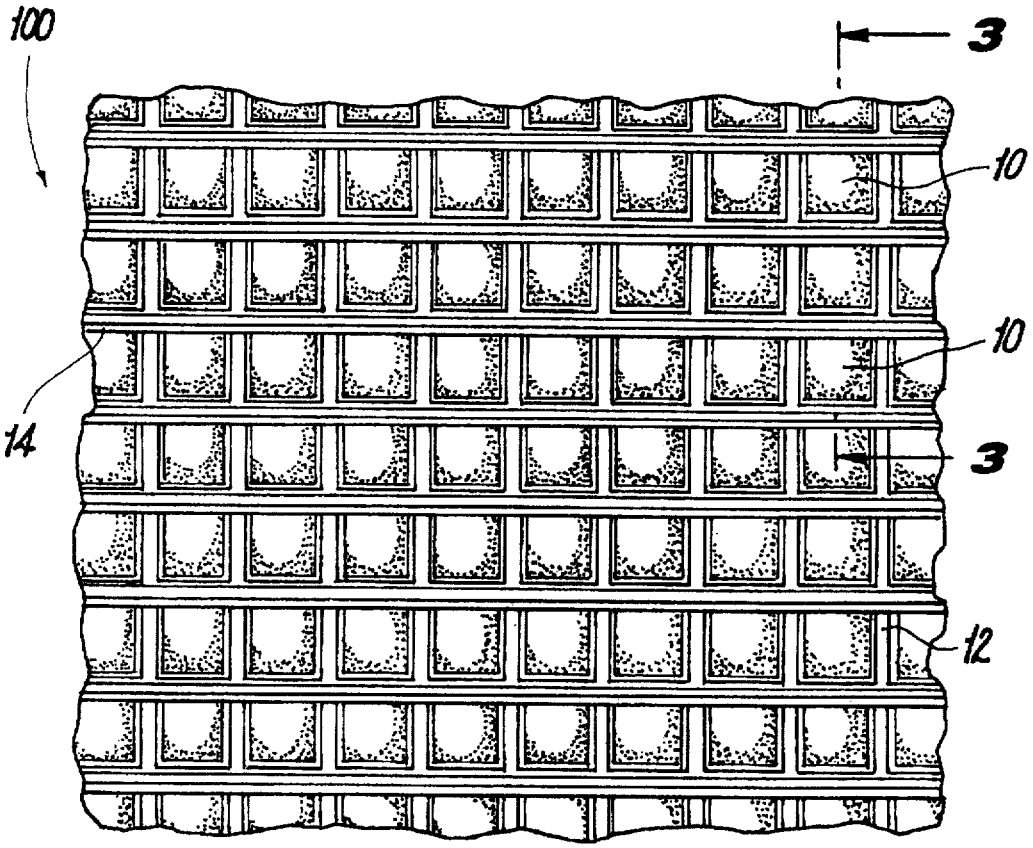
FIG. 2 is a front elevational view of a portion of the lamp display system shown in FIG. 1 illustrating the matrix arrangement of the light filtering lens assemblies of the subject invention.

Referring now to FIGS. 1 and 2, display system 100 is constructed in a two-dimensional matrix format with a multiplicity of lens assemblies 10 arranged in a plurality of horizontal rows and a plurality of vertical columns in front of a corresponding arrangements of lamps to falter and direct light in such a manner so as to achieve a desired two-dimensional pattern of illuminated lamps or groups of lamps. The lens assemblies may be monochromatic or colored, and groups of different colored lens assemblies may be provided to produce desirable lighting effects and presentations. In the embodiment of display system illustrated in FIGS. 1 and 2, the lens assemblies are dimensioned to be mounted on 2.5 inch centers. However, as discussed hereinbelow with respect to FIG. 11, the dimensions of the lenses may vary according to the matrix display system with which they are employed.

Figure 3:
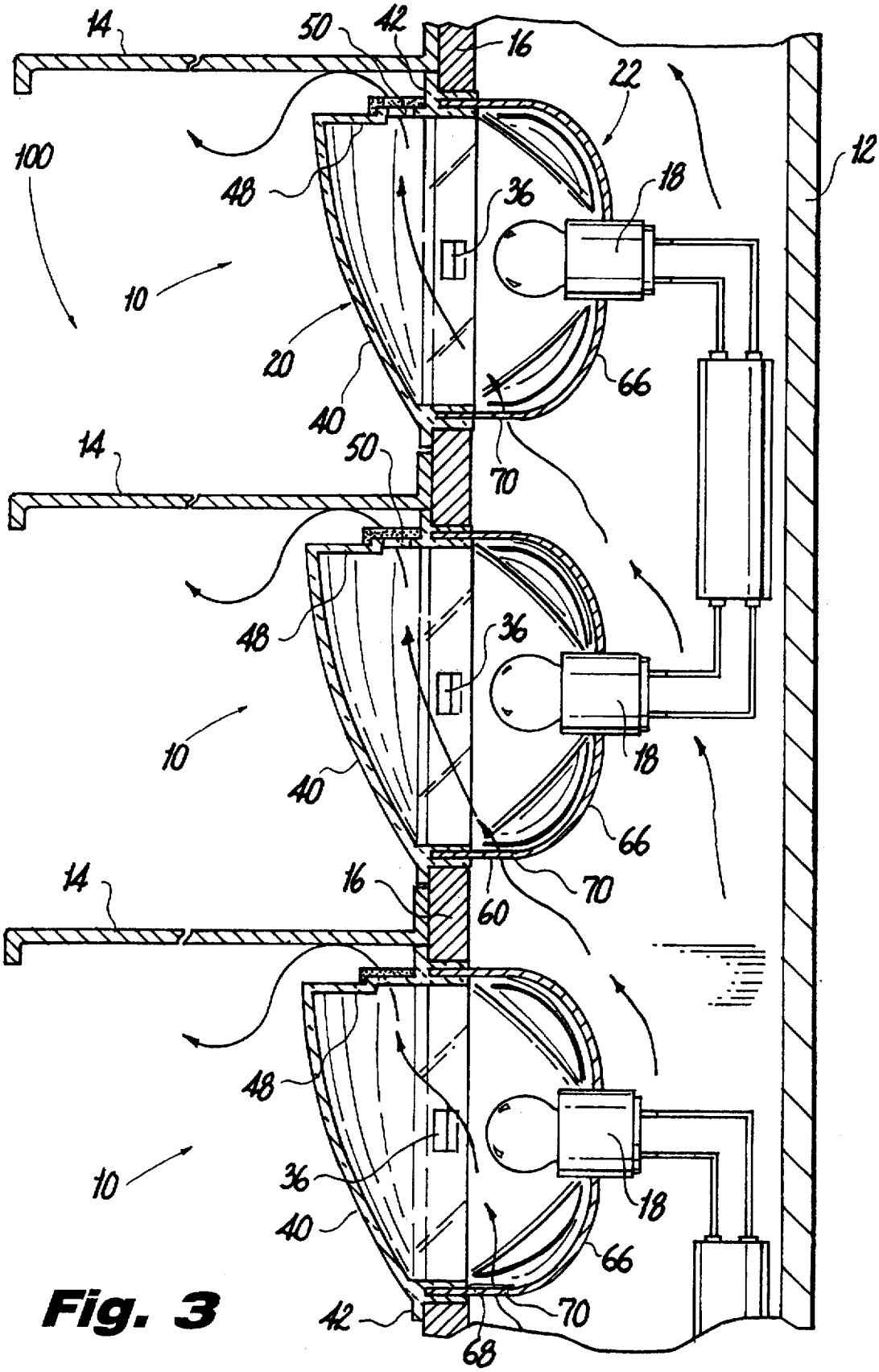
FIG. 3 is a cross-sectional view, taken along line 3—3 of FIG. 2, illustrating several of the lens assemblies of the subject invention arranged in a vertical column adjacent a corresponding column of incandescent Imps, and further illustrating the flow pattern of air traveling through the lens assemblies to cool the incandescent lamps associated therewith.

Referring to FIG. 3, each of the lens assemblies 10 forming display system 100 is held within a matrix framework 12 and each horizontal row of lens assemblies 10 is covered by an elongated louver 14. The louvers are oriented at a slight downward angle of about between 3° and 5° degrees, and are intended to serve several functions including, for example: shielding the lens surfaces from inclement weather; shading the surfaces of lenses from sunlight and exterior lighting; and dissipating heat produced by the lamps located adjacent each of the lenses.

In the drawings, the matrix framework 12 is shown as a series of support struts 16 for receiving the lens assemblies. Those skilled in the art will readily appreciate that the framework should be constructed to minimize the spacing between adjacent lenses so as to produce greater visual uniformity and clarity. The matrix framework 12 also defines an enclosure for supporting the incandescent lamps 18 associated with each of the lens assemblies. In addition, the enclosure serves as a duct or plenum to direct forced or pressurized cooling air to the lens assemblies. This method of cooling will be discussed in greater detail hereinbelow with respect to the manner in which the lens assemblies are ventilated.

With continuing reference to FIG. 3, in conjunction with FIGS. 4–10, each of the lens assemblies 10 mounted within the matrix framework 12 of display system 100 includes a lens portion 20 and a reflector portion 22. The lens portion 20 is of monolithic construction and is fabricated from a tough transparent thermoplastic material, such as, for example, a polycarbonate material. Lens portion 20 includes a generally rectangular frame section 24 and a lens section 25. Frame section 24 is defined by opposed upper and lower walls 26 and 28, respectively, and opposed side walls 30 and 32. As best seen in FIGS. 9 and 10, a substantially continuous channel or groove 34 is formed in the walls of frame section 24 to receive and engage the peripheral walls of reflector portion 22, so as to effectively interlock the two components of the assembly together to form a unitary module. In addition, as shown for example in FIGS. 5–7, ramped alignment tabs 36 are formed on the exterior surface of each wall of frame section 24 to facilitate mounting of the lens assembly 10 within the matrix framework 12 of display system 100.

Figure 6:
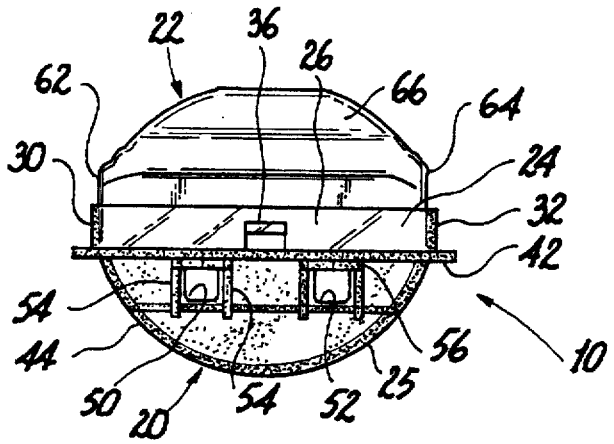
FIG. 6 is a top plan view of the lens assembly of FIG. 4 illustrating the spaced apart exhaust ports provided therein.
Figure 4:
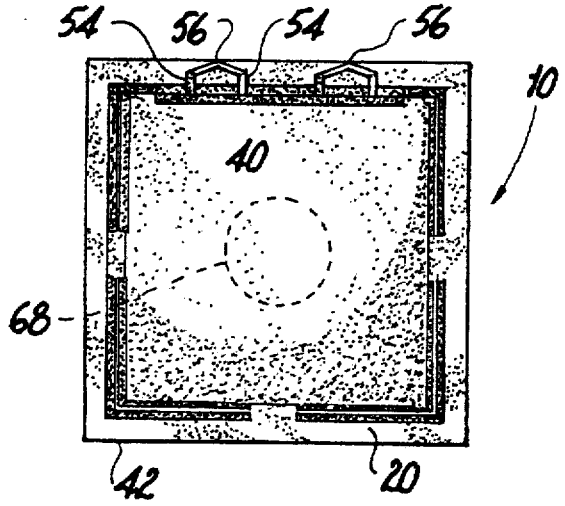
FIG. 4 is a front elevational view of the a lens assembly constructed in accordance with a preferred embodiment of the subject invention.
Figure 5:
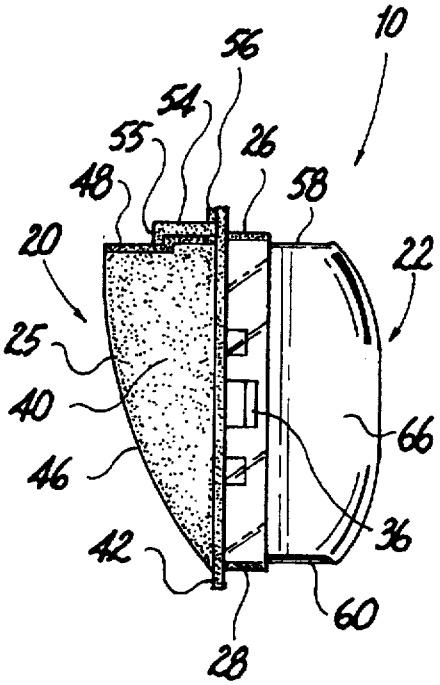
FIG. 5 is a side elevational view of the lens assembly of FIG. 4 illustrating the downwardly inclined curved lens surface thereof.

As illustrated in FIG. 5, the lens section 25 of lens portion 20 is defined by an inclined curved lens surface 40 which projects outwardly from a generally planar peripheral lip region 42. As shown in FIG. 6, for example, lip region 42 extends outwardly from and beyond the peripheral walls of frame section 24 and is configured to mount flush against the support struts 16 of matrix framework 12, as best seen in FIG. 3. As illustrated most effectively in FIG. 8, the junction between the periphery of lens surface 40 and the lip 42 is essentially seamless so that the structures generally taper into one another. The exterior of lens surface 40 and lip region 42 is advantageously textured with a matte finish to reduce glare from sunlight and exterior lighting. In contrast, as illustrated in FIGS. 9 and 10, the interior of lens surface 40 is extremely smooth so as not to interfere with the even distribution of light emanating from the lamp adjacent thereto.

Referring to FIG. 8, the inclined curved configuration of lens surface 40 is more specifically defined as a downwardly inclined double convex configuration which approximates the shape of a generally hemi-paraboloidal formation. As seen in FIG. 6, when lens assembly 10 is viewed from the top, the uppermost leading edge 44 of lens surface 40 defines a generally arc-like segment of a circle, and when lens assembly 10 is viewed from the side, as shown in FIG. 5, the forward most leading edge 46 of lens surface 40 defines a portion of a generally parabolic curve. The inclined double convex configuration of lens surface 40 provides a horizontally extending viewing angle of about 160° degrees, far greater than prior art lens based display systems. In addition, the downward inclination of the lens surface substantially minimizes glare from sunlight and exterior lighting.

Those having ordinary skill in the art to which the subject invention appertains will readily appreciate that the geometry of lens surface 40 can be varied or optimized to achieve the desired wide viewing angle. For example, rather than define a portion of a parabolic curve, the forward most leading edge 46 of lens surface 40 could delineate a portion of a curve defined by a trigonometric, hyperbolic or exponential function.

Referring now to FIGS. 5 and 6, the lens section 25 of lens portion 20 further includes a stepped top wall 48 which extends rearwardly from the uppermost leading edge 44 of lens surface 40 to the peripheral lip region 42. A pair of spaced apart exhaust ports 50 and 52 are formed in top wall 48 to facilitate the egress of cooling air from lens assembly 10. Exhaust ports 50 and 52 are each provided with upstanding lateral guard rails 54 on either side thereof and an adjoining cross-beam 56 to the rear thereof. The guard rails and cross-beams, together with the riser 55 forming the step in top wall 48 function to inhibit water and debris from entering exhaust ports 50 and 52.

Figure 7:
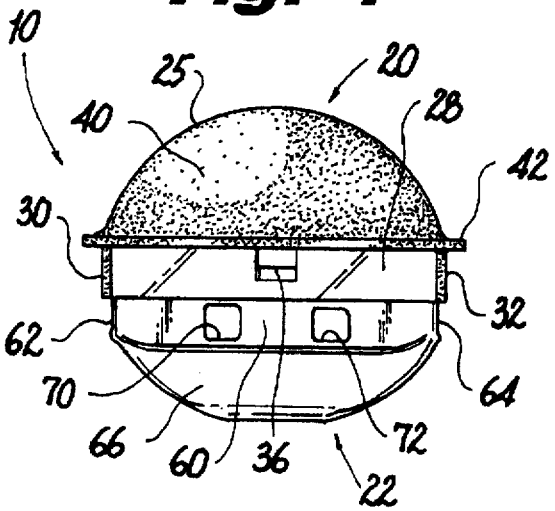
FIG. 7 is a bottom plan view of the lens assembly of FIG. 4 illustrating the spaced apart intake ports provided therein.

Referring once again to FIG. 3, now in conjunction FIGS. 7 and 9, the reflector portion 22 of lens assembly 10 is of monolithic construction and is fabricated by pressing and folding a highly reflective thin gauged sheet metal material, such as, for example, aluminum. In use, the aluminum reflector portion also serves as a heat sink to dissipate heat generated by the lamp adjacent thereto. Reflector portion 22 is defined by opposed upper and lower substantially planar walls 58 and 60, respectively, opposed substantially planar side walls 62 and 64, and a generally concave rear wall 66. The substantially planar peripheral walls of reflector portion 22 are dimensioned and configured for reception and engagement within the continuous channel 34 formed in the walls of frame section 24. The concave rear wall 66 of reflector portion 22 has a series of compound curves formed therein which serve to enhance the horizontal viewing angle provided by lens assembly 10. As best seen in FIG. 9, a centrally located circular aperture 68 extends through rear wall 66 for receiving incandescent lamp 18.

Referring now to FIG. 7, a pair of spaced apart intake ports 70 and 72 are formed in the lower wall 60 of reflector portion 22. As illustrated schematically by the air flow lines shown in FIG. 3, intake ports 70 and 72 function to permit the ingress of pressurized or forced cooling air from the enclosure of matrix framework 12 into lens assembly 10. Once the cooling air is admitted into lens assembly 10, it flows passed the bulb of the incandescent lamp 18 disposed therein, and out from the spaced apart exhaust ports 50 and 52 formed in the top wall 48 of lens section 26. This method of ventilating the lens assemblies, together with the heat dissipation effects of reflector portion 22 and louvers 14 substantially increases the operating life of the lamp bulbs, thereby reducing the mean time between bulb replacement, as well as the costs associated therewith.

Referring now to FIG. 11, another lens assembly constructed in accordance with a preferred embodiment of the subject invention is illustrated and is designated generally by reference number 110. Lens assembly 110 is constructed in substantially the same manner as lens assembly 10 of FIG. 8, in that it includes a monolithically formed thermoplastic lens portion 120 having an inclined curved lens surface 140, and a monolithically formed metal reflector portion 122 having a concave rear wall 160. Lens assembly 110 differs however from lens assembly 10, in that it is smaller in size and dimension. More particularly, lens assembly 110 is dimensioned so as to be mounted within a matrix framework on 1.5 inch centers. In addition, due its lesser dimensions, a singular exhaust port 150 is formed in the top wall 148 of lens portion 120, and although not shown in the drawings, a singular intake port is formed in the lower wall of reflector portion 122.

Although the lens assemblies of the subject invention have been described with respect to a preferred embodiment, it is apparent that modifications and changes can be made thereto without departing from the spirit and scope of the invention as defined by the appended claims.

What is claimed is:

1. A lens assembly for a matrix lamp display system which comprises:

a) a reflector portion having a rear wall and a plurality of peripheral walls extending forwardly from said rear wall; and b) a lens portion having a peripheral frame adapted and configured to engage the peripheral walls of said reflector portion, an inclined curved lens face extending forwardly from said frame, and a top wall extending rearwardly from an upper edge of said lens face to said frame.

2. A lens assembly as recited in claim 1, wherein at least one air intake port is defined in at least one of said peripheral walls of said reflector portion.

3. A lens assembly as recited in claim 2, wherein at least one air exhaust port is defined in said top wall of said lens portion.

4. A lens assembly as recited in claim 1, wherein said inclined curved lens face has a downwardly inclined double convex configuration delineated by at least two curves, each curve being defined by a different mathematical function.

5. A lens assembly as recited in claim 1, wherein said lens face has a textured surface finish.

6. A lens assembly as recited in claim 1, wherein said lens portion is constructed from a thermoplastic material.

7. A lens assembly as recited in claim 1, wherein said frame portion includes means from engaging said peripheral walls of said reflector portion.

8. A lens assembly as recited in claim 1, wherein said rear wall of said reflector portion has a concave reflective surface on an interior area thereof.

9. A lens assembly as recited in claim 8, wherein the rear wall of said reflector portion has a centrally located aperture extending therethrough for receiving an incandescent lamp.

10. A lens assembly as recited in claim 1, wherein said reflector portion is constructed from a metallic material.

11. A lens assembly for a matrix lamp display system which comprises:

a) a reflector portion having a rear wall and a plurality of peripheral walls extending forwardly from said rear wall; and b) a lens portion having a peripheral frame including means for engaging the peripheral walls of said reflector portion, a downwardly inclined curved lens face extending forwardly from said frame, and a ventilated top wall extending rearwardly from an upper edge of said lens face to said frame.

12. A lens assembly as recited in claim 11, wherein at least one air intake port is defined in at least one of said peripheral walls of said reflector portion.

13. A lens assembly as recited in claim 12, wherein at least one air exhaust port is defined in said top wall of said lens portion.

14. A lens assembly as recited in claim 13, wherein said downwardly inclined lens face is has a double convex configuration defined by at least two curves approximating a generally hemi-paraboloidal formation.

15. A lens assembly as recited in claim 11, wherein said lens face has a textured surface finish.

16. A lens assembly as recited in claim 11, wherein said lens portion is constructed from a transparent thermoplastic material.

17. A lens assembly as recited in claim 11, wherein said means for engaging said peripheral walls of said reflector portion includes a substantially continuous channel extending about the periphery of said frame for receiving and engaging the peripheral walls of said reflector portion.

18. A lens assembly as recited in claim 11, wherein said rear wall of said reflector portion is constructed from a metallic material and includes a concave reflective surface on an interior area thereof.

19. A lens assembly as recited in claim 18, wherein the rear wall of said reflector portion has a centrally located aperture extending therethrough for receiving an incandescent lamp.

20. An illuminated display system comprising:

a) a support structure;

b) a plurality of lamps supported by said support structure and disposed in a matrix arrangement; and c) a lens assembly disposed adjacent each of said plurality of lamps, each lens assembly having a frame portion and a lens portion, said lens portion having an inclined curved lens face extending forwardly from said frame portion.

21. An illuminated display system as recited in claim 20, wherein said lens portion includes a ventilated top wall extending rearwardly from an upper edge of said lens portion to said frame portion.

* * * * *